United States Patent [19]

Libertini et al.

[11] 4,349,318

[45] Sep. 14, 1982

[54] BOLTLESS BLADE RETAINER FOR A TURBINE WHEEL

[75] Inventors: Zoltan L. Libertini, Stamford; Theodore Ivanko, Fairfield, both of Conn.

[73] Assignee: Avco Corporation, Stratford, Conn.

[21] Appl. No.: 109,719

[22] Filed: Jan. 4, 1980

[51] Int. Cl.[3] ..... F01D 5/32

[52] U.S. Cl. ..... 416/220 R; 416/221

[58] Field of Search ..... 416/220 R, 221, 218

[56] References Cited

U.S. PATENT DOCUMENTS

| | | | |
|---|---|---|---|
| 2,755,062 | 7/1956 | Hill | 416/221 |
| 3,096,074 | 7/1963 | Pratt | 416/221 |
| 3,807,898 | 4/1974 | Guy | 416/220 R |
| 4,108,571 | 8/1978 | Mawson | 416/221 |

FOREIGN PATENT DOCUMENTS

| | | | |
|---|---|---|---|
| 1128113 | 8/1956 | France | 416/218 |

*Primary Examiner*—Douglas Hart

*Attorney, Agent, or Firm*—Ralph D. Gelling

[57] ABSTRACT

In a dynamically balanced turbine wheel wherein a plurality of turbine blades are secured to a turbine disc by conventional fir tree mounting arrangements, a retaining assembly is provided to positively restrain movement of the turbine blades in an axial direction forward or aft of the wheel. A tang is machined in the leading edge of the root of each blade and bears against the forward face of the disc to prevent axial movement of the blade in the aft direction. To restrain each blade from axial movement in the forward axial direction, a radial groove is machined into the aft side of the disc and the trailing edge of the root of each blade for accommodating a wire-type retainer which is held in place by a generally cylindrical plate. The latter is piloted on the disc and secured by means of a split retainer ring which is accommodated in opposed continuous slots provided in the plate and the disc. The split retainer ring includes enlarged projections which are accommodated in enlarged portions of the opposed continuous slots, with the projections being symmetrically arranged about the periphery of the split retainer ring. The resulting assembly is dynamically balanced, and prevents relative rotation between the plate and the disc, while preventing axial movement of the blades in the cooperating channels provided in the periphery of the turbine disc.

10 Claims, 13 Drawing Figures

BOLTLESS BLADE RETAINER FOR A TURBINE WHEEL

The subject invention generally relates to a turbine blade retaining assembly, and more particularly, an assembly for use with a disc having blades inserted in axial channels, and including a boltless blade retainer for preventing axial movement of the blades relative to the disc.

A turbine wheel as used in a gas turbine engine in a dynamically balanced unit generally consisting of super alloy blades which are attached to a rotating disc. The base of each blade is usually of a so-called "fir tree" configuration to enable it to be firmly attached to the disc and still have room for thermal expansion. The "fir tree" attachment of a rotor blade to the turbine disc is effective in restraining the blade against radial, centrifugal forces; however, during high speed, high temperature operation of the turbine, the axial flow of air through the turbine imparts a constant axial force on the blades so as to bias the blade roots axially relative to the fir tree channels in the turbine disc. Heretofore, in order to restrain the blades against axial excursions, both forwardly and rearwardly, it has been common to employ various pinning and bolting systems, including wound and crimped wires for interconnecting the blade roots to the turbine disc. As is readily apparant, with continued high speed operation of the turbine, and especially in view of the high thermal gradients developed in the components of the turbine assembly, after a period of time the bolts may tend to loosen, thereby possibly resulting in relative movement between the components, and possible damage to the turbine. In addition, the provision of bolts about the periphery of the turbine wheel could give rise to dynamic unbalancing of the overall assembly, which also could create problems during high speed, high temperature operation of the turbine wheel.

Accordingly, it is the object of the subject invention to overcome the shortcomings of the prior art and provide a boltless blade retainer assembly for precisely and securely positioning the blades with respect to the turbine disc so that optimum performance is obtainable.

It is a further object of the subject invention to provide a new and improved blade retention, assembly which results in a dynamically balanced turbine unit, and which is operative to firmly secure the turbine blades to the disc and prevent axial excursions thereof.

It is still another object of the subject invention to provide a new and improved blade retention apparatus in a turbine wheel wherein the retention apparatus is effective to prevent axial excursions of the blade roots in the channels provided in the periphery of the turbine disc, and which apparatus may be readily disassembled for replacement or maintenance of the turbine blades or turbine disc.

It is another object of the subject invention to provide a resilient, blade retention apparatus for preventing axial excursions of the blades mounted in the channels of a turbine wheel, which apparatus provides a constant restraining force on the blades at high speed and transient operating conditions of the turbine.

In accordance with the subject invention, a turbine wheel includes a disc having a plurality of elongated "fir tree" channels provided in the periphery of the disc at uniformly spaced locations. Each turbine blade has a root portion corresponding in configuration to the "fir tree" configuration of the channel portion in the disc. The leading edge of the blade root is provided with a radially-inwardly extending flange or tang which in the assembled condition of the turbine wheel bears against the leading or forward face of the disc thereby preventing axial movement of the blade in the aft direction. A blade retention means which does not include bolts or loose wires is provided for holding the aft end of the blade fixedly secured to the turbine disc to prevent axial blade movement in a forward direction. At the aft end of the blade root a continuous locking groove is defined by peripheral cut-outs provided in the blade roots and the disc, and a continuous retainer element in the form of a stainless steel wire of annular cross-section is mounted in said locking groove. The blade retention means further includes a cylindrical plate member and a split retaining ring to maintain the stainless steel wire retainer element in the continuous locking groove. The cylindrical plate member is concentrically mounted on said disc and includes a radially, outwardly extending portion which peripherally abuts the open side of the locking groove for maintaining the continuous retainer element in place. The cylindrical plate member and the disc include opposed peripheral continuous slots in which is disposed a split retainer ring for interlocking said disc and plate member to prevent relative axial movement, as well as relative rotational movement therebetween. The resulting retaining structure does not include any bolts, is dynamically balanced, and provides a constant retention force on the blades at high speed operating conditions of the turbine. The split retainer ring enables the retaining assembly to be readily disassembled for replacement or maintenance of the turbine blades or turbine disc.

The above and other objects and advantages of the invention will become apparent from a reading of the following detailed description taken in conjunction with the drawings in which.

Figure 1:
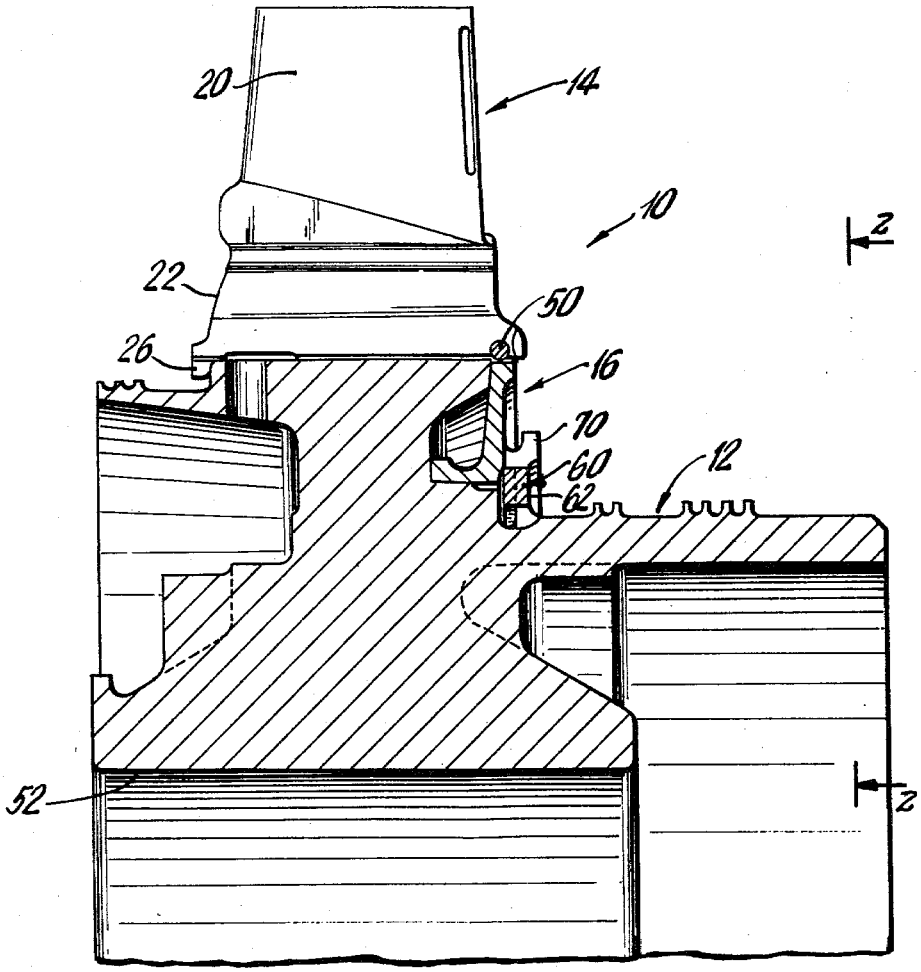
FIG. 1 is a side elevational view, partially in section, of the assembly of a turbine blade to a turbine disc employing the blade retention apparatus of the subject invention.

Referring to FIG. 1, the turbine wheel of the subject invention is generally designated by the numeral 10 and is intended to be employed in a gas turbine engine. The turbine wheel 10 basically comprises a turbine disc 12 to which is releasably connected a plurality of blades 14, with the blades being secured to the turbine disc by the blade retention assembly of the subject invention, as designated by the numeral 16.

Figure 9:
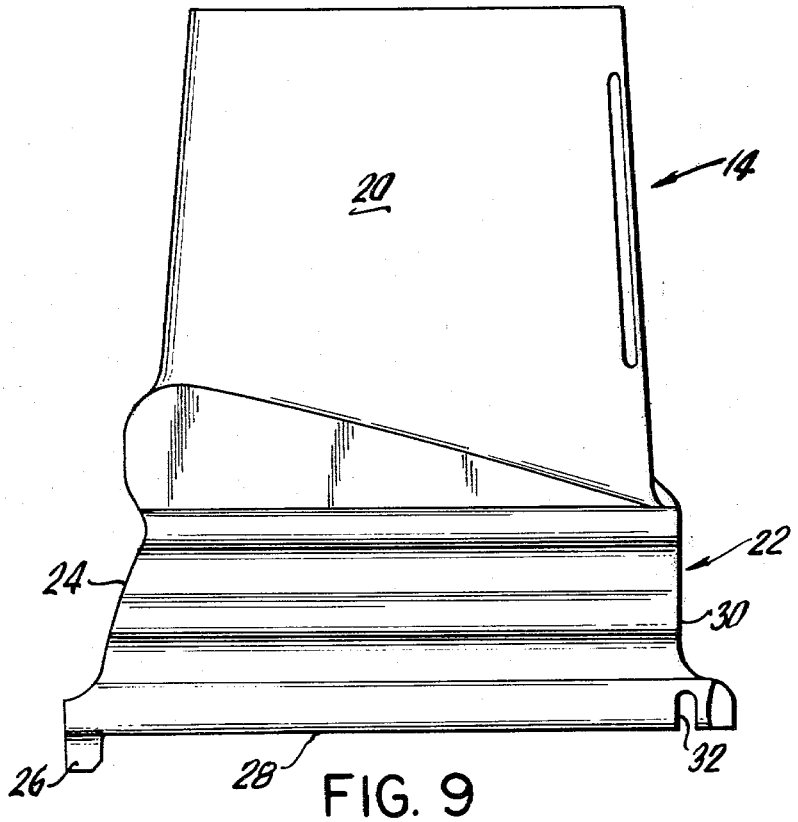
FIG. 9 is a side elevational view of a turbine blade for use in the subject turbine rotor assembly.
Figure 10:
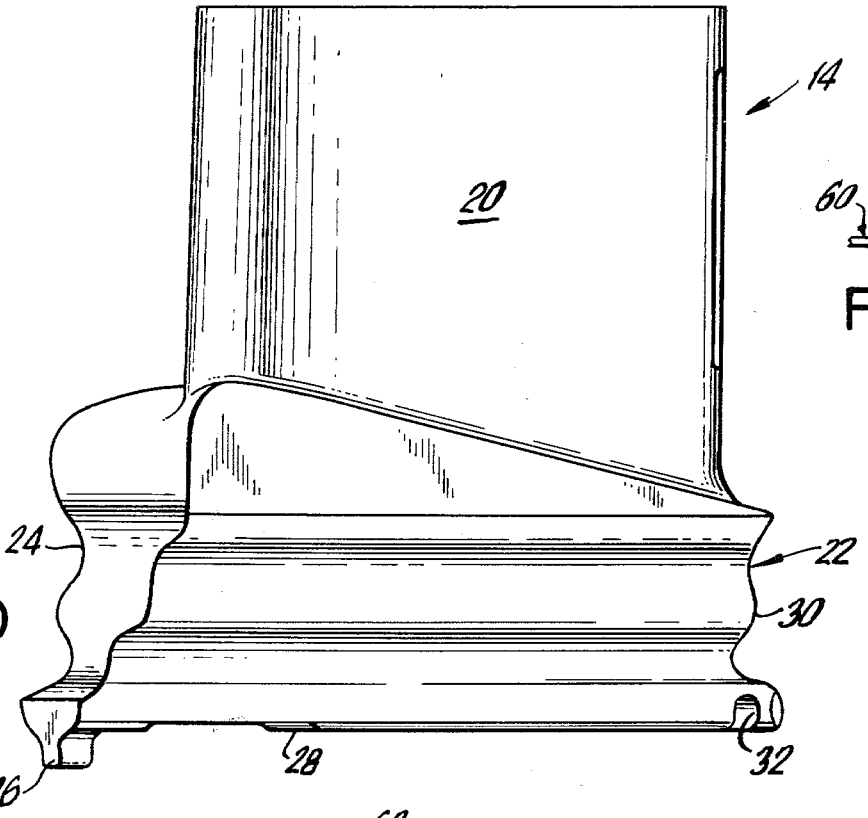
FIG. 10 is a perspective view of the root portion of a turbine blade employed in the subject invention.

Referring to FIGS. 9 and 10, each turbine blade 14 includes an airfoil section 20 and a root portion 22 of conventional fir tree configuration which is adapted to be accommodated within a similarly configured channel in the periphery of the turbine wheel. Disposed at the leading edge 24 of rotor blade 14 is a flange or tang 26 which is disposed radially inwardly of the inner surface 28 of the root portion 22. Disposed at the trailing edge 30 of the rotor blade 14, and preferably machined out of the radially inner surface 28 of the blade is a cut-out 32 of generally annular cross-section, which cut-out 32 is adapted to accommodate a portion of the blade retention assembly 16, as more fully described hereinafter.

Figure 2:
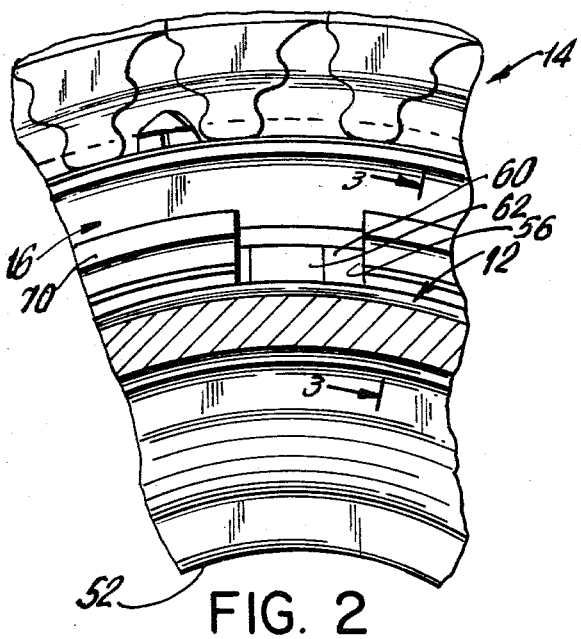
FIG. 2 is an elevational view of the turbine wheel assembly of the subject invention as viewed from a downstream position and along line 2—2 in FIG. 1.
Figure 5:
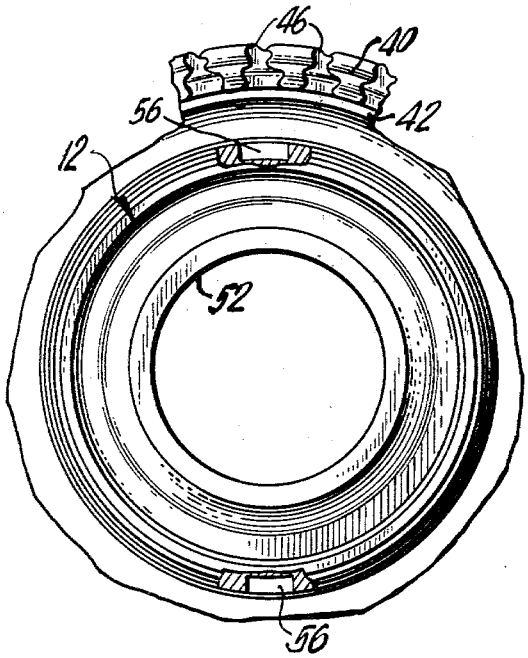
FIG. 5 is a rear elevational view of the turbine disc of FIG. 4, with portions thereof being partially in section.
Figure 6:
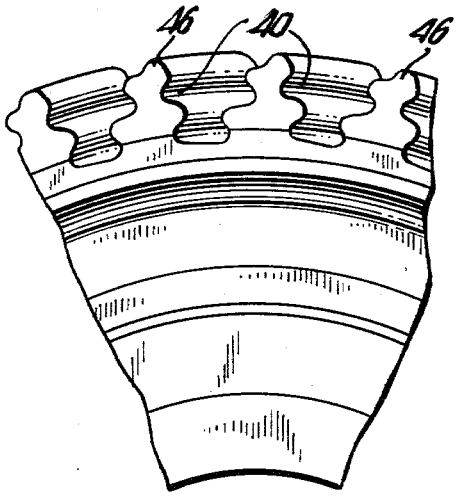
FIG. 6 is a partial perspective view of the periphery of a turbine disc and particularly illustrating the fir-tree peripheral configuration of the disc.

Referring to FIGS. 5 and 6, the periphery of the turbine disc 12 is preferably formed to define a plurality of axially-extending channels 40 which are of fir tree configuration and are adapted to cooperate with and accommodate the fir tree configuration of the root portions 22 of the blades 14. The interengagement of the root portions 22 with the channels 40 is shown in FIG. 2.

Figure 4:
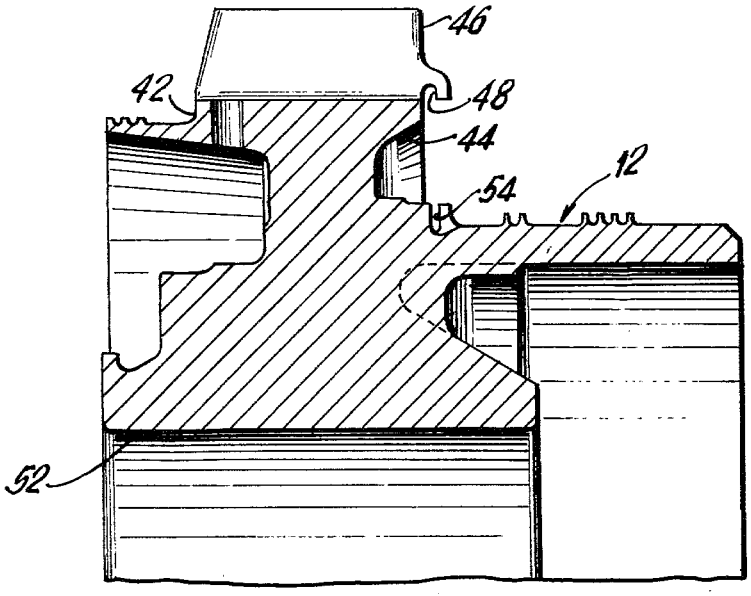
FIG. 4 is a partial sectional view of the turbine disc of the subject invention.

As illustrated in FIGS. 1 and 4 the leading edge surface of the disc 12 includes a flattened portion 42 against which the tangs 26 are adapted to abut. At the downstream or trailing edge of the disc 12 a cut-off 44 is provided for accommodating the blade retention assembly 16. In addition, cut into the trailing edge portion of the structural members 46 which define the fir tree channels 40 are peripheral cut-outs 43 (see FIG. 2), with the cut-outs 48 being aligned with and contiguous to the cut-outs 32 in the blades 14 such that a continuous locking groove is defined by said cut-outs 48 and 32. A continuous retainer element 50 (see FIG. 1) is adapted to be accommodated in said locking groove, and is preferably made of a spring, stainless steel wire of annular cross-section, and forms a portion of the blade retention assembly 16.

Figure 3:
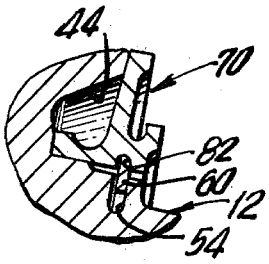
FIG. 3 is a cross-sectional view taken along line 3—3 in FIG. 2.

Turning to FIGS. 1 and 4, the turbine disc 12 includes a central, annular opening 52 through which the shaft of the gas turbine engine extends. In addition, as illustrated in FIG. 3, a radially inwardly extending circumferential slot 54 is cut into the turbine wheel in the cut-out 44 for accommodating a split retainer ring 60 (see FIGS. 11, 12 and 13) forming a portion of the blade retention assembly 16, as more fully described hereinafter. The slot 54 circumferentially extends about the turbine disc and is of sufficient cross-section to completely accommodate the split retainer ring 60 when in its fully radially compressed configuration. In addition, at opposed, spaced locations along the circumference of the slot 54 enlarged detents 56 are provided (see FIGS. 2 and 5) for accommodating locking projections 62 forming portions of the split retainer ring 60. The enlarged detents 56 are disposed in spaced, opposed relationship about the circumference of the slot 54, in order to maintain the dynamic balance of the turbine wheel, as more fully described hereinafter.

Figure 7:
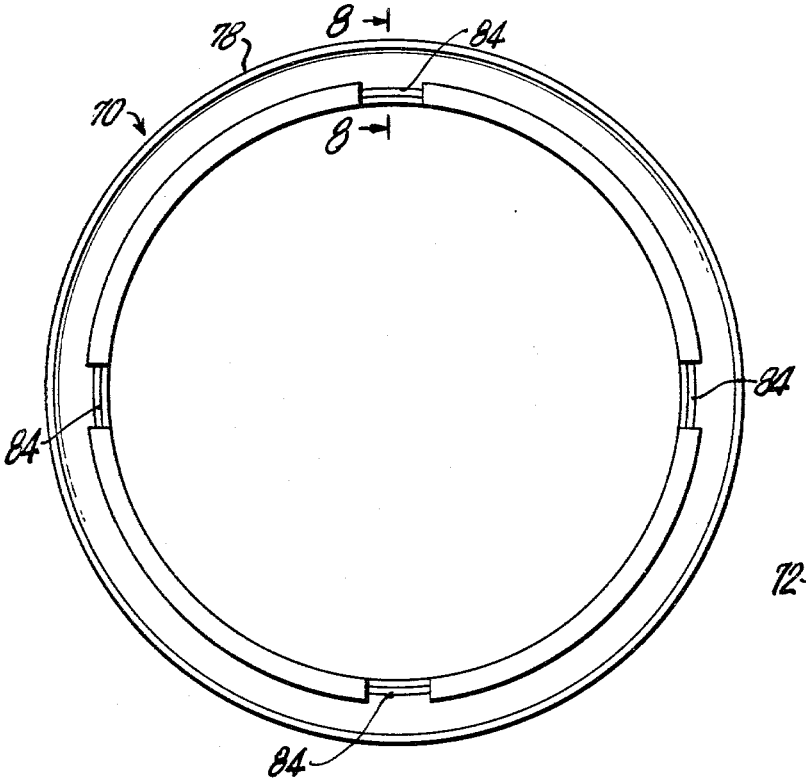
FIG. 7 is a rear elevational view of the cylindrical plate member forming a portion of the blade retention apparatus of the subject invention.
Figure 8:
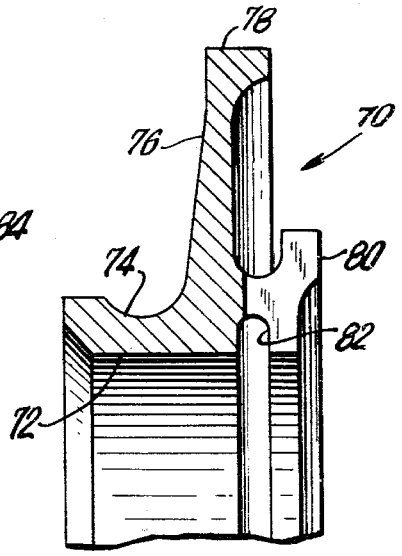
FIG. 8 is a cross-sectional view of the cylindrical plate member of the subject invention taken along line 8—8 in FIG. 7.

A generally cylindrical plate member 70 also forms a portion of the blade retention assembly 16, and is illustrated in FIGS. 7 and 8. Cylindrical plate member 70 includes an inner diameter 72 which corresponds to the inner diameter of the annular cut-off 44 provided in the turbine disc 12 whereby the cylindrical member 70 may be piloted or concentrically mounted on the turbine disc. More particularly, in the assembled condition of the blade retention assembly 16, the cylindrical portion 74 of the cylindrical member 70 is disposed within the cut-out 44, with radially outwardly extending projection 76 abutting against the trailing edge of the turbine disc 12. The circumferential edge 78 of the radially extending projection 76 is aligned with the locking groove defined by the cut-outs 32 in the blades 14 and the cut-outs 48 in the turbine disc for retaining the continuous retainer element 50 in fixed position, as shown in FIG. 1. The cylindrical member 70 also includes a trailing edge portion 80 including a radially inner continuous cut-out or slot 82 which, in the assembled condition of the blade retention assembly 16 (see FIG. 1) is aligned with and opposed to the continuous slot 54 in the turbine disc (see FIG. 3). As in the construction of the slot 54, slot 82 in the cylindrical plate member 70 includes spaced, enlarged detents 84 which are aligned with and cooperate with the detents 56 in the slot 54 to provide means for locking the cylindrical plate member 70 to the turbine disc in order to prevent relative rotation thereto, as explained hereinafter.

Figure 13:
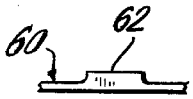
FIG. 13 is a partial top elevational view of the split retainer ring of FIGS. 11 and 12 and more particularly illustrating a plan view of a projection forming a portion of the split retainer ring.
Figure 11:
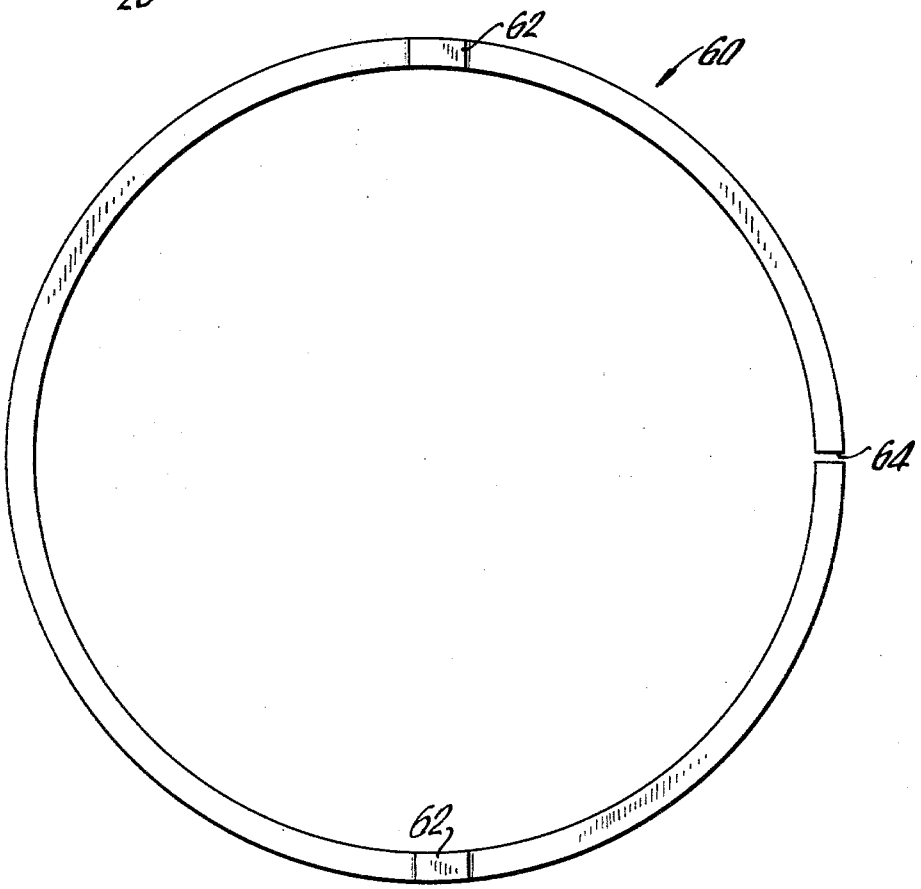
FIG. 11 is an elevational view of the split retainer ring employed in the subject invention.
Figure 12:
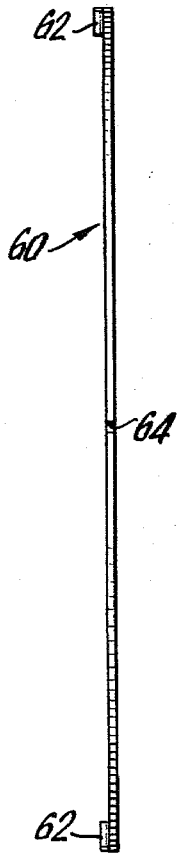
FIG. 12 is a side elevational view of the split retainer ring illustrated in FIG. 11.

The split retainer ring 60 forming a portion of the blade retention assembly 16 is illustrated in FIGS. 11, 12 and 13, and perfectly comprises a stainless steel split ring of a diameter corresponding to the diameter of the locking slot defined by the opposed continuous slots 54 and 82. Ring 60 is split as at 64, with the collapsed diameter of the split ring 60 corresponding to the inner diameter of the continuous slot 54 in the turbine disc whereby, with the split ring being fully compressed, the entire split ring 60 is accommodated within the slot 54. At opposed diametrical portions of the split ring 60, anti-rotation projections 62 are provided, and in the assembled condition of the blade retention assembly 16 (as illustrated in FIG. 1) the projections 62 are disposed downstream relative to the plane of the split ring 60.

In the assembly of the turbine wheel 10, the individual blades 14 are mounted in the channels 40 extending about the periphery of the turbine disc 12, by sliding the fir-tree root portion 22 of each blade in an axial, rearward direction until the tang 26 abuts against the front surface 42 of the turbine disc 12. At such time the cut-out 32 disposed in the trailing edge 30 of each blade 14 is aligned with the cut-outs 48 in the structural members 46 extending radially outwardly about the periphery of the turbine disc 12, thereby defining a continuous locking groove at the trailing edge of the blade assembly. The continuous retainer element 50, which is preferably made of a stainless steel wire of annular cross section, is then manipulated so as to be snap fitted into said continuous locking groove. It is noted that at such time, axial movement of each blade in its associated channel 40 in the turbine disc 12 is inhibited by the tang 26 and the wire 50. More particularly, movement of the rotor blade in an axial aft direction is inhibited by the abutment of the tang 26 with the front surface 42 of the turbine disc. Axial, forward movement of the blade 14 is inhibited by virtue of the mechanical interconnection between the stainless steel wire 50 and the continuous locking groove defined by the cut-outs 32 and 48 respectively provided in the blades and the turbine disc.

In order to maintain the continuous wire element 50 in place, and without resorting to the use of bolts or crimped wire means, the blade retention assembly 16 of the subject invention includes cylindrical plate member 70 and the split retainer ring 60. In the assembly of the blade retention assembly 16, next, the split retainer ring 60 is slipped over the trailing edge portion of the turbine disc 12, with the anti-rotation projections 62 disposed downstream of the plane of the split ring. The split ring 60 is positioned so as to be in alignment with the continuous cut-out 54 in the turbine disc, and with the anti-rotation protrusions aligned with the enlarged detent portions 56 of the slot 54. At such time, the split ring 60 is radially inwardly compressed to a sufficient diameter so as to be wholly disposed within the annular groove 54, thereby enabling the mechanic to slip the cylindrical plate member 70 over the annular groove 54 and into the cut-out 44 of the turbine disc 12. The cylindrical plate member 70 is inserted into the annular cut-out 44 until such time as the leading edge portion of the cylindrical plate member 70 abuts against the forward wall of the cut-out 44, at which time the circumferential edge 78 of the radially extending projection 76 is aligned with the open, radially inner portion of the locking groove defined by the cut-outs 32 and 48. Accordingly, the radially extending projection 76, cooperating with the locking groove, effectively encases and entraps the continuous retaining wire element 50 in position for preventing axial movement of a blade in a forward axial direction. At such time, the continuous slot 82 of the cylindrical plate member 70 is aligned with the slot 54, thereby enabling the split retainer ring 60 to expand radially outwardly to the locking position as shown in FIG. 3. The split retainer ring 60 mechanically interlocks the cylindrical plate member 70 to the turbine disc, thereby preventing axial movement of the cylindrical plate member 70 relative to the turbine disc.

Accordingly, in the assembled condition of the blade retention assembly 16 a positive locking or encasing of the retainer wire element 50 is insured. In addition, in the final assembled condition of the split retainer ring 60, the anti-rotation projections 62 are disposed in the enlarged, opposed detents 56 and 84 formed in the opposed continuous slots 54 and 82, thereby preventing rotation of the cylindrical plate member 70 relative to the turbine disc 12. Hence, in the final assembled condition of the blade retention assembly 16, each blade is fixedly secured to the turbine disc, with the fir-tree interconnection restraining the blade in opposition to the centrifugal forces acting on the blade during high speed operation of the turbine wheel, and with the cooperation of the tangs 26 and the blade retention assembly 16 preventing axial movement of the blades both in the forward and aft directions relative to the turbine disc 12. Furthermore, the blade retention assembly 16 and, in particular, the cylindrical plate member 70 thereof fixedly and positively encases the continuous wire retainer element 50 within the locking groove, and the split ring 60 positively locks the cylindrical plate member 70 within the turbine disc 12. In addition, ring 60 prevents relative rotation between the turbine disc and the cylindrical plate member 70. Accordingly, no bolts or crimped wires are required for securing the blade to the turbine disc, and the positive mechanical interconnections forming portions of the blade retention assembly 16 are of generally cylindrical configuration, thereby insuring dynamic balancing and minimum vibration of the turbine wheel. Still further, by virtue of the interconnection and interaction of the elements forming the blade retention assembly 16, a very efficient and sturdy construction is provided for the high speed operation of the turbine 10.

Although the invention has been described with respect to a preferred embodiment thereof, it will be understood by those skilled in the art that various changes and modifications may be made without departing from the spirit and scope of the invention, and it is intended, therefore, to cover all such changes and modifications in the appended claims.

What is claimed is:

1. A rotor assembly comprising a disc having a plurality of elongated channels provided therein and spaced along its periphery, and a plurality of blades, said blades each having a root portion corresponding in configuration to said channel portion, one end of each blade root portion being provided with a tang which bears against one end of the disc adjacent a channel to prevent longitudinal movement of the blade root in the channel in one axial direction, the opposite end of said blade root and the disc including cooperating peripheral cut-outs which define a continuous locking groove, blade retention means disposed at said opposite end of the blade root for preventing longitudinal movement of the blade in the channel in the opposed axial direction, said blade retention means including:

a continuous retainer element disposed in said locking groove;

a generally cylindrical plate member concentrically mounted on said disc and including a radially outwardly extending peripheral portion which cooperates with the locking groove for maintaining said continuous retainer element in place, said cylindrical plate member and the disc including opposed, peripheral continuous slots, and a split retainer ring disposed in said opposed continuous slots.

2. A rotor assembly as in claim 1 wherein said opposed continuous slots include enlarged detents, with said split retainer ring including projections which are disposed in said detents for preventing relative rotation between said cylindrical plate member and the disc.

3. A rotor assembly as in claim 1 wherein said elongated channels in the disc are of fir tree configuration.

4. A rotor assembly as in claim 1 wherein said continuous retainer element is a stainless steel wire of annular cross-section.

5. A rotor assembly as in claim 1 wherein said tang extends in a radially inward direction relative to said blade root.

6. A rotor assembly as in claim 1 wherein the continuous slot in the disc is of sufficient cross-section to accommodate the split retainer ring when the latter is radially compressed to its smallest diameter to facilitate assembly of the blade retention means.

7. An improved blade retention apparatus for use with a disc having blades inserted in axial fir tree slots disposed in the periphery thereof wherein the improvement comprises:

(a) flange means extending from the leading edge of the root of each blade in a radially inward direction and abutting the leading edge surface of the disc;

(b) the trailing edge of said blade root and the disc having cooperating peripheral cut-outs which define a continuous locking groove;

(c) a retainer element means disposed in said locking groove; and (d) means for maintaining said retainer element means in place including a generally cylindrical plate member concentrically mounted on said disc and including a radially outwardly extending peripheral portion which cooperates with said continuous locking groove, said cylindrical plate member and the disc including opposed, peripheral continuous slots; and a split retainer ring disposed in said opposed continuous slots.

8. An improved blade retention apparatus as in claim 7 wherein said opposed continuous slots include enlarged detents, with said split retainer ring including projections which are disposed in said detents for preventing relative rotation between said cylindrical plate member and the disc.

9. An improved blade retention apparatus as in claim 7 wherein said retainer element means is a stainless steel wire of annular cross-section.

10. An improved blade retention apparatus as in claim 7 wherein the continuous slot in the disc is of sufficient cross-section to accommodate the split retainer ring when the latter is radially compressed to its smallest diameter to facilitate assembly of the means for maintaining said retainer element means in place.

* * * * *